US005305836A

United States Patent [19]

Holbrook et al.

[11] Patent Number: 5,305,836

[45] Date of Patent: Apr. 26, 1994

[54] SYSTEM AND METHOD FOR CONTROLLING DRILL BIT USAGE AND WELL PLAN

[75] Inventors: Philip Holbrook, Houston, Tex.; Sanjeev Mittal, New Delhi, India

[73] Assignee: Baroid Technology, Inc., Houston, Tex.

[21] Appl. No.: 865,120

[22] Filed: Apr. 8, 1992

[51] Int. Cl.[5] ..... E21B 44/00

[52] U.S. Cl. ..... 175/39; 73/151; 175/26

[58] Field of Search ..... 175/39, 40, 26; 73/151

[56] References Cited

U.S. PATENT DOCUMENTS 5,216,917 6/1993 Detournay ..... 175/39 X

*Primary Examiner*—William P. Neuder

*Attorney, Agent, or Firm*—Browning, Bushman, Anderson & Brookhart

[57] ABSTRACT

Hardware, software and methods for controlling the usage of well drill bits and other aspects of well drilling plans. At least a portion of a given well is drilled with a given drill bit. An abrasive-wear-affecting variable (drilling strength) for the lithology which has been most recently drilled with the bit is continually evaluated. The current abrasive wear of the bit by the total lithology which has been drilled thereby is continually calculated, based on the abrasive-wear-affecting variable. Continued use or retirement of the bit is controlled in accord with the wear calculation. Relative pore pressure at the current site of the drill bit is a useful by product which can be independently used to control other aspects of the well drilling plan, e.g. mud weight and the setting of casing.

56 Claims, 4 Drawing Sheets

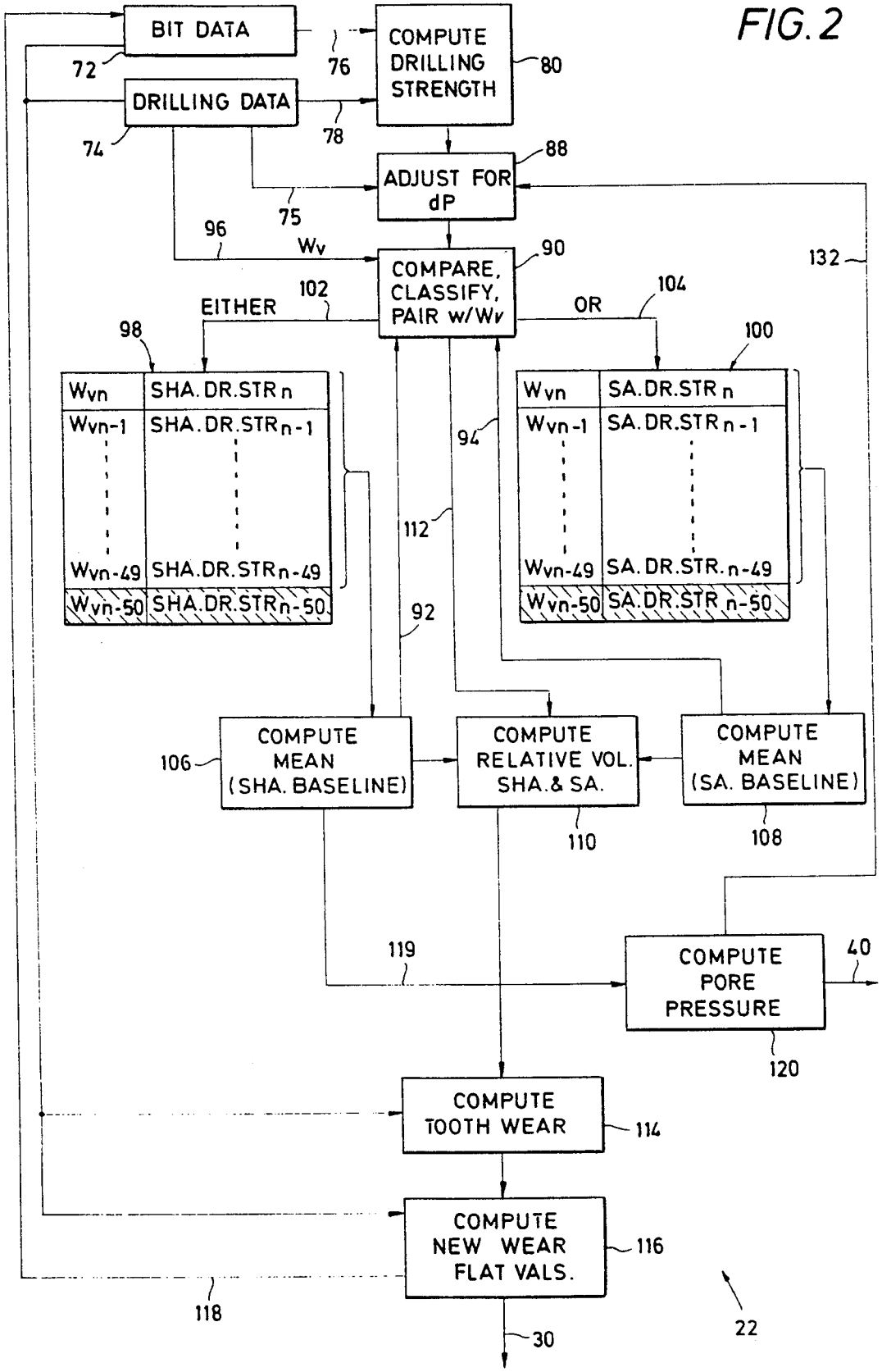
FIG. 2
BIT DATA
72
76
COMPUTE DRILLING STRENGTH
80
DRILLING DATA
74
78
88
ADJUST FOR dP
75
96
Wv
90
COMPARE, CLASSIFY, PAIR w/Wv
132
EITHER
102
OR
104
98
100
Wvn
SHA. DR.STR n
Wvn-1
SHA. DR.STR n-1
Wvn-49
SHA.DR.STR n-49
Wvn-50
SHA.DR.STR n-50
Wvn
SA.DR.STR n
Wvn-1
SA.DR.STR n-1
Wvn-49
SA. DR.STR. n-49
Wvn-50
SA.DR.STR n-50
94
112
92
106
COMPUTE MEAN (SHA. BASELINE)
COMPUTE RELATIVE VOL. SHA.& SA.
110
COMPUTE MEAN (SA. BASELINE)
108
119
COMPUTE PORE PRESSURE
40
120
COMPUTE TOOTH WEAR
114
COMPUTE NEW WEAR FLAT VALS.
116
118
30
22

FIG. 4
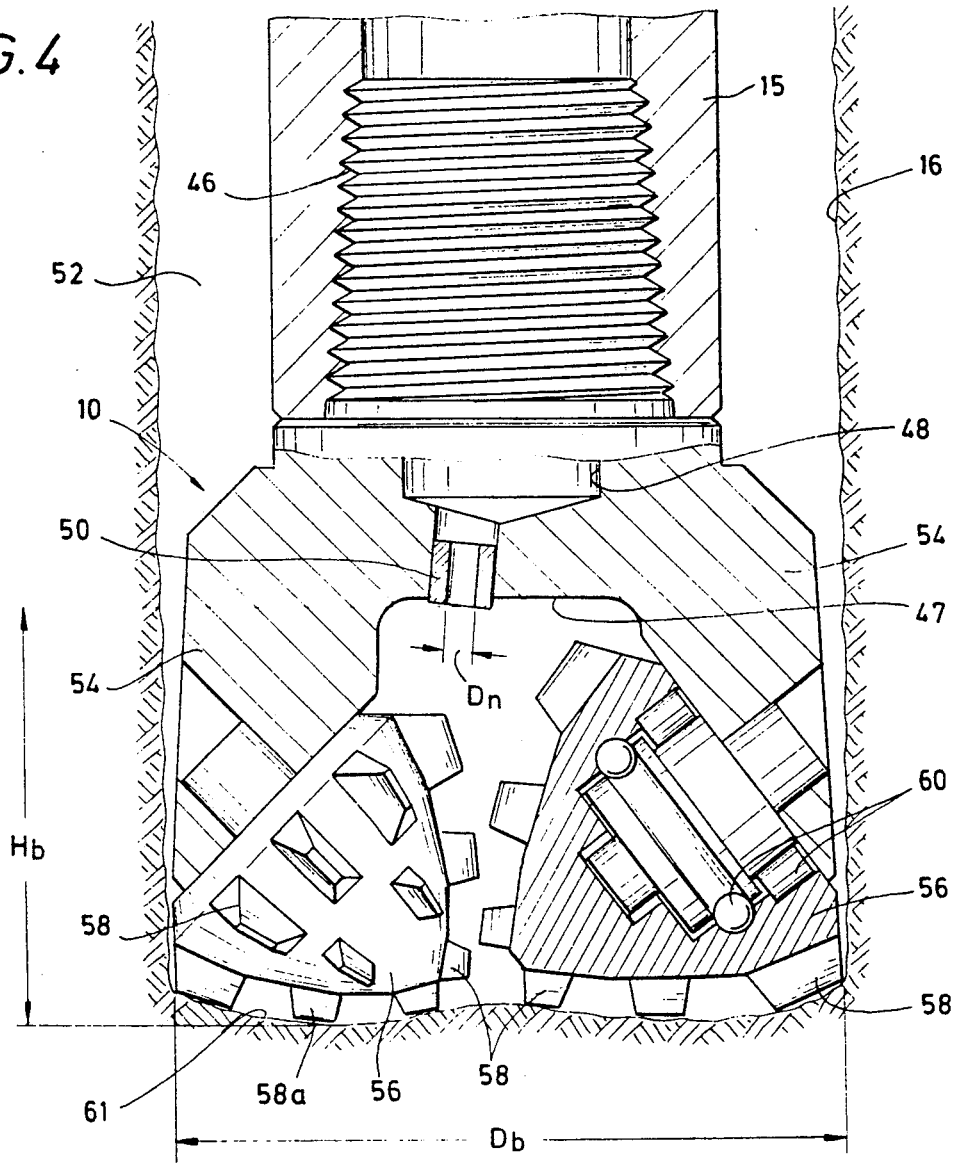
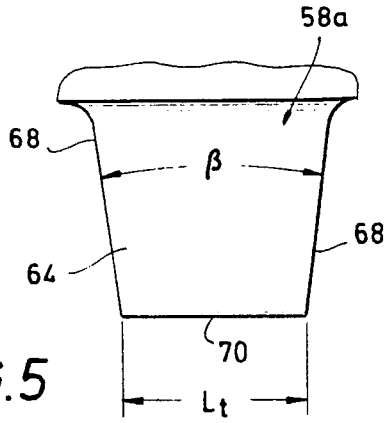
FIG. 5
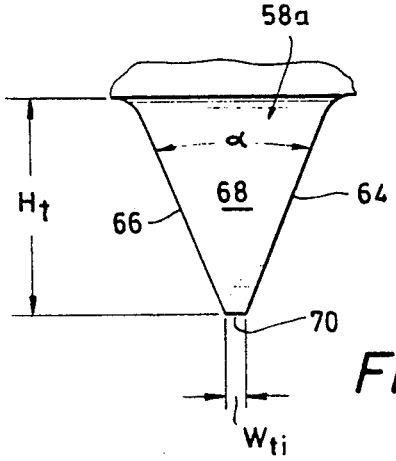
FIG. 6

SYSTEM AND METHOD FOR CONTROLLING DRILL BIT USAGE AND WELL PLAN

BACKGROUND OF THE INVENTION

1. Field of the Invention

The present invention pertains to the drilling of wells, such as oil and gas wells and, more particularly, to controlling the usage of a well drill bit and other aspects of execution of a well drilling plan. Before a well is drilled, a plan is developed for at least roughly projecting the timing of such activities as the replacement of the drill bit, changing the weight of the drilling mud, setting casing, etc. "Timing" in this context can literally refer to hours of operation with reference to the replacement of a drill bit, but can also connote the depth at which certain actions are taken, especially changes in mud weight and the setting of casing.

It is rare to follow such a plan precisely. Since a certain amount of projection, or even guess work, is involved in developing the plan, the plan must sometimes be modified based on actual experience while drilling the well. That is to say, decisions must constantly be made as to whether or not to continue following the plan, i.e. maintain the plan, or modify the plan by taking a planned action sooner or later, or at a greater or lesser depth, than originally planned.

For example, drill bits wear in use, and eventually to such a degree that it becomes ineffective to continue drilling with the same bit, and that bit must be replaced. However, replacing the bit requires a "trip" of the entire drill string, which is an expensive proposition, particularly if the well has been drilled to a substantial depth. Therefore, it is highly desirable to avoid tripping the string prematurely, i.e. when the bit still has a good amount of useful life remaining. On the other hand, it is important to replace the bit promptly when it has become ineffective.

Unlike the prior art known to Applicants, the present invention models wear of a given drill bit as a function primarily of formation abrasiveness, and more specifically, the abrasiveness of the formation which has actually been drilled by that bit.

In addition, the present invention provides an improved way of determining the pore pressure, which can, in itself, be used to evaluate other aspects of the well drilling plan, e.g. whether or not to change mud weight and when to set casing.

2. Description of the Prior Art

Various means have been devised for attempting to predict or actively determine bit wear. Some of these have addressed the determination of wear in the bearings of the drill bit, so that there remained a need for a means for determining wear of the outer drilling structure, typically teeth, of the bit.

Some of the most common means currently used to attempt to predict bit wear simply proceed on the assumption that the formation which will be drilled in a current well will be similar to that experienced in a nearby well which has already been drilled, so that the rate of bit wear will be comparable. No matter how sophisticated these systems may be, they are not as accurate as they might be because the lithology in nearby wells may vary; in other words, the basic hypothesis of such a system is not always valid.

For example, U.S. Pat. No. 4,914,591 to Warren discloses a system in which a rock compressive strength log for a first well is generated. While a second such well is being drilled, another such log is generated and compared with the first. On the assumption that the formation features of the two wells are similar, when a significant deviation between the two logs is observed, it is assumed that the bit is worn or damaged. Thus, this system assumes that, if the rock compressive strength "feels" higher, the explanation must be that the bit is worn or damaged. It does not take into account that the bit may be in good shape, but rock at the depth in question in the second well is in fact stronger than rock at the same depth in the first well. The system does not attempt to determine abrasiveness of the rock in the second well and model current bit wear thereon.

Other examples are given in a paper by K.L. Mason, titled "Tricone Bit Selection using Sonic Logs," SPE 13256.

Still other systems have contrived to determine the actual wear of the drilling structure of a bit currently in use. These have also had room for improvement.

More particularly, a number of systems have provided means, literally triggered by physical wear, to somehow change the fluid flow characteristics of the drilling mud when the bit has become worn to a certain degree. For example, U.S. Pat. No. 3,058,532 utilizes a probe or detector which directly detects wear of the outer surface of a drill bit. When this probe or detector detects wear beyond a certain limit, a signal, detectable at the surface, is produced.

In U.S. Pat. No. 2,560,328, a blind (closed ended) tube communicating with the interior of the bit is positioned to be worn by the rock being drilled along with the bit's cutting structure. When this tube is worn through, its blind or closed end is opened, so that drilling mud can pass therethrough, and the operator will detect a change in the pressure of the drilling mud.

Similar schemes are described in U.S. Pat. No. 2,580,860, No. 4,785,895, No. 4,785,894, No. 4,655,300, No. 3,853,184, and No. 3,363,702. U.S. Pat. No. 2,925,251 is similar except that the signal produced is electrical, rather than fluidic.

U.S. Pat. No. 3,578,092 pertains to a system for determining wear of a stabilizer blade in which that blade encapsulates a pocket of crypton which is released when a certain degree of wear occurs.

The above systems are all susceptible to inaccuracies and/or mechanical failures.

U.S. Pat. No. 4,030,558 involves magnetically recovering and analyzing bit fragments which are carried back to the surface in the drilling mud. The analysis involves observation under a microscope. It is therefore tedious, time consuming and requires a fair degree of specialization by the analyst.

U.S. Pat. No. 3,345,867 does attempt to extrapolate bit wear from ongoing drilling conditions. In particular, the ratio between the bit rotational speed and the cone rotational speed, in a roller cone type bit, is calculated. The system relies on the idea that variations in that ratio give an indication of the wear of the teeth on the outside of the cones. The cone rotational speed is determined by observing the frequency response of the vertical accelerations in the drill string. This system is too simplistic and may not be as accurate as is possible. It does not attempt to analyze the lithologies actually being drilled nor to determine bit wear as a function of abrasion by the formation which has been drilled.

Other systems which attempt to utilize real-time parameters but which, again, are too simplistic and fail to take actual formation characteristics into account, are disclosed in U.S. Pat. No. Re. 28,436 and U.S. Pat. No. 4,773,263.

U.S. Pat. No. 4,926,686 to Fay discloses a system for determining bit wear dynamically, i.e. while the bit is drilling. The basis for this is variation in a curve obtained by plotting torque as it varies with weight on bit, i.e. the effect the wear has on the operation of the apparatus. Data about the formation appears to be derived prior to drilling the well in question. There is no dynamic determination of a wear-affecting variable of the formation, such as abrasiveness. Rather, wear is modelled as a function of drilling parameters affected by wear.

A similar approach is taken in a paper by T.M. Burgess and W.G. Lesso, titled "Measuring Wear of Milled Tooth Bits Using MWD Torque and WOB," SPE-/IADC 13475.

Similarly, U.S. Pat. Nos. 2,669,871, No. 3,774,445, and No. 3,761,701 all attempt to model bit wear as a function of various drilling values, such as weight-on-bit, rate of penetration, revolutions per minute, and time. However, these models fail to take into account the abrasiveness of the lithology being drilled, which is a highly significant factor, particularly when attempting to model wear of the exterior, i.e. teeth, of a bit. The same is true of the method disclosed in U.S. Pat. No. 4,685,329, which considers torque-on-bit, weight-on-bit, rate of penetration and revolutions per minute.

U.S. Pat. No. 2,096,995 discloses a system which does attempt to project certain information about the lithology being drilled. However, this information is not used to attempt to determine or model bit wear, and, on the contrary, the patent treats bit wear as only a relatively minor factor which might be taken into account in connection with the basic lithology determination.

U.S. Pat. No. 4,064,749 teaches a system directed at determining formation porosity from drilling response. The patent does mention a determination of "tooth dullness." The operational input for this determination is quite different from that of the present invention, and it would appear that the determination lacks adequate precision, as it will only determine dulling in excess of a bit grade No. 5.

U.S. Pat. No. 4,794,535 involves an attempt to determine when a bit should be changed using a mathematical model. However, this model, which is based on bit economics, simply uses the formation abrasion calculated from the previous bit run; it does not attempt to model bit wear based on the lithology actually drilled by the bit in question. Nor does this method include as much input as to the bit geometry as does the present invention, and to that extent, the results are less precise.

U.S. Pat. No. 3,898,880 is even less sophisticated. In essence, wear is predicated simply as a function of time, with no adjustment for the lithology being drilled, nor for the actual bit geometry.

U.S. Pat. No. 4,627,276 probably comes closer to any of the above to effectively utilizing lithology actually drilled in a given bit run in some type of wear determination. However, the system only "kicks in" to produce such a determination when the bit is drilling in shale. At that time, the bit may have already been significantly worn by having drilled through sandstone. By way of contrast, the present invention continually interprets the nature of the lithology currently being drilled, and continually determines current bit wear, taking into account all the lithology which has been drilled up to that point.

A paper entitled "Use of Single-Cutter Data in the Analysis of PDC Bit Designs: Part II/Development and Use of the PDC Wear COMPUTER CODE" by D.A. Glowka and published in the August 1989 issue of JPT (*Journal of Petroleum Technology*), describes a technique for predicting wear of the cutters of PDC type drag bits using formation abrasion and sliding distance of a tooth as primary factors. However, the system was developed through laboratory experiments where the lithologies were known, and the article does not teach any means for analyzing lithology drilled in real-time. Among other differences, this system also utilizes additional parameters which, while feasible in laboratory analysis, would be very difficult to implement in real-time, e.g. the depth of cut of each tooth or cutter.

Considered cumulatively, the prior art shows that determinations of bit wear are a significant problem, to which much attention has been given, but apparently without any really definitive solution. More specifically, it appears that the known methods generally suffer from an inability to accurately determine bit wear on the basis of the nature, and more specifically abrasiveness, of the lithology actually drilled by a given bit.

Turning to the pore pressure aspect, U.S. Pat. No. 4,981,037 to Holbrook et al and a related SPE paper No. 1666, "Petrophysical-Mechanical Math Model for Real-time Wellsite Pore Pressure/Fracture Gradient Prediction" describe a way of determining pore pressure on the basis of lithology actually drilled in the well in question. However, this prior system views pore pressure as a function of absolute rock properties. Furthermore, it is limited to a determination of the pore pressure at a site a significant distance above the then current location of the bit, e.g. seven to fifty feet.

SUMMARY OF THE INVENTION

Embodiments of the present invention encompass methods, hardware and software for controlling drill bit usage and/or other aspects of a well drilling plan. The wear of the cutting structure, i.e. teeth, of a drill bit is mathematically modeled on a continual basis utilizing real-time data which take into account the abrasiveness of the very lithology which has been drilled by the bit under consideration. Since that lithology is so important in the degree of wear, at least of the exterior cutting structure of the bit, the present method is believed to produce much more accurate results, and should drastically reduce the extent to which drill bits are changed either prematurely or too late.

More specifically, at least a portion of a given well is drilled with a given drill bit. An abrasive-wear-affecting variable for the lithology which has been most recently drilled is continually evaluated. Based on that variable, abrasive wear of the bit by the total lithology which has been so drilled thereby is continually calculated. The continued use, or conversely, retirement, of the bit is controlled in accord with that wear calculation.

The aforementioned abrasive-wear-affecting variable is preferably drilling strength of the formation. Wear is calculated as a function of at least that drilling strength and the linear distance traversed by a point on the drill bit. Preferably, the wear is calculated as a function also of a wear coefficient which is adjusted for the recently drilled lithology as well as for the nature of the drilling mud being used.

The depth of the well is continually, i.e. at least periodically if not continuously, measured. The aforementioned drilling strength is re-evaluated each time the bit increases the depth of the well by a given increment, e.g. one foot. Each drilling strength value so obtained is compared with at least one drilling strength reference and classified as one of at least two given categories of lithology, e.g. sandstone or shale. Respective arrays of drilling strength values are maintained for each such category of lithology. Each drilling strength value, as it is so classified, is entered into the respective array, and the oldest value in that array is simultaneously removed. The values in each respective array are averaged, and the relative volumes of the respective categories of lithology are determined. Wear is calculated as a function of drilling strength by calculating it as a function of those relative volumes, which in turn are functions of the drilling strength.

The drilling strength of the rock, as "felt" by the bit, is a function not only of the nature of the rock itself, but also of the pressure differential across the interface between the wellbore and the formation being drilled. Therefore, to give a more accurate model of the drilling strength, and thus a more accurate determination of its effect on the bit, each drilling strength value obtained in the manner described above is preferably adjusted for that pressure differential, in the current lithology, before it is compared and classified according to lithology.

One of the above-mentioned arrays, preferably the array for shale, has its average used to compute pore pressure, which is thus determined as a value relative to the drill bit and its action, and at a location immediately adjacent the bit. The pore pressure can be used to periodically update the differential pressure which, as mentioned above, is used to adjust drilling strength for greater accuracy in calculating the wear of the bit. In addition, the pore pressure can be used, independently of any bit wear calculation, to evaluate other aspects of the well drilling plan, whereafter such aspect is either maintained or modified. For example, based on such an evaluation of pore pressure, the point at which mud weight is changed and/or the point at which casing is set may be changed from that originally prescribed by the plan.

The data used to perform various of the steps described above include, in part, bit data taken from the configuration and nature of the bit and its cutting teeth. As previously mentioned, these data are periodically updated to account for the wear modeled in the method itself. One such item of bit data is at least one current tooth flat parameter such as width or area. At the beginning of a run, this flat parameter is measured or taken from manufacturers' specs. However, since it is this parameter which increases due to wear, the system of the present invention continually calculates a current value for that tooth flat parameter, and that updated parameter, while a final or near final result of the calculations in question, is also part of the new data which will be used in the next calculation by virtue of such updating. The other data represent current drilling conditions. Some are known, and others can be obtained by existing technology such as measurement-while-drilling or "MWD" techniques available in the art. The only aspect which must be entirely empirically determined from previous bit runs is a strength concentration factor, which also goes into the calculation of drilling strength described above.

In another aspect, embodiments of the present invention encompass methods, hardware and software for controlling drill bit usage in which at least a portion of the well is drilled with a given bit, the lithology which has been most recently drilled is continually evaluated, and a wear coefficient is continually adjusted for that recently drilled lithology. The current abrasive wear of the bit is continually calculated based on the wear coefficient, and the continued use or retirement of the bit is controlled in accord with that wear calculation. Preferably, the adjustment of the wear coefficient is done so as to produce wear calculations increasing in magnitude as the proportion of sandstone relative to shale, in the lithology so drilled, increases.

Various objects, features and advantages of the present invention will be made apparent by the following detailed description, the drawings and the claims.

BRIEF DESCRIPTION OF THE DRAWINGS

FIG. 2 is a detailed flow diagram illustrating the functions performed by the computer 22.

FIG. 4 is a longitudinal cross-sectional view of a roller cone drill bit of a type to which the present invention can be applied, showing one of the roller cones in elevation, and illustrating where various input bit data are taken.

FIG. 5 is an enlarged detailed front view of one of the teeth of the bit shown in FIG. 4 illustrating where other bit data are taken.

FIG. 6 is a side view of the tooth of FIG. 5 showing where still other bit data are taken.

DETAILED DESCRIPTION

Figure 1:
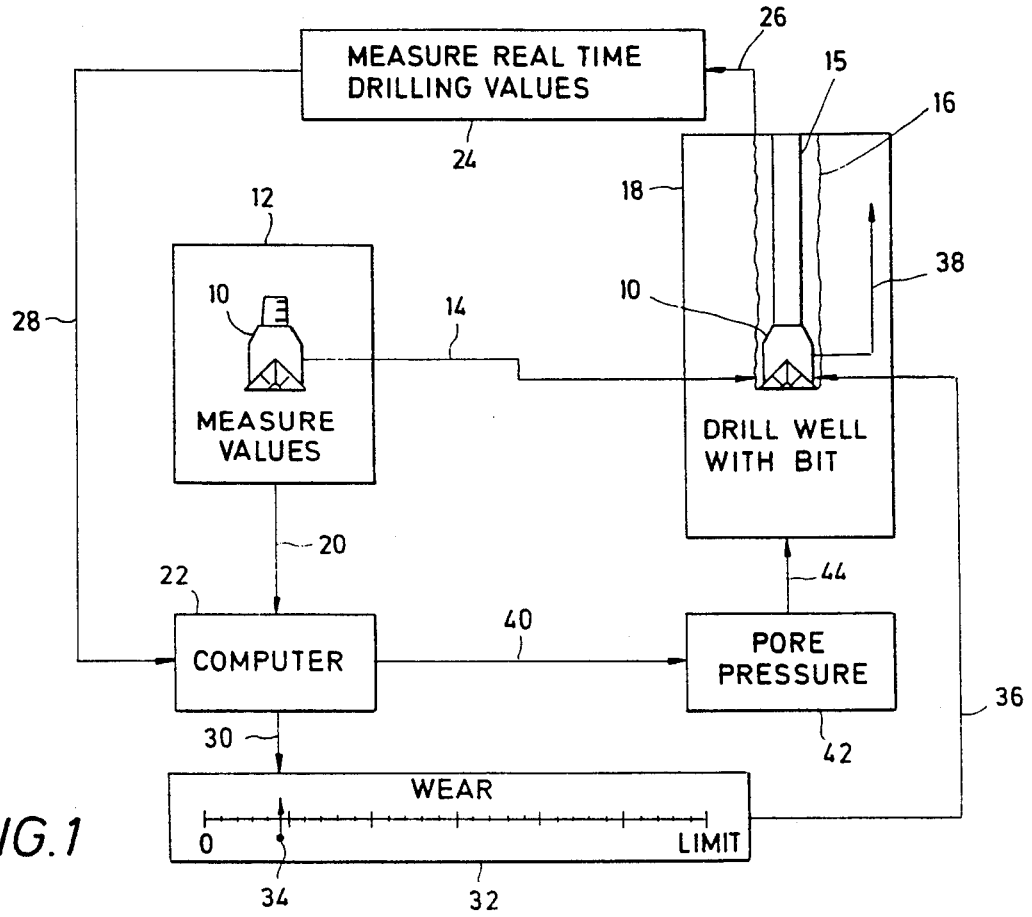
FIG. 1 is a flow diagram illustrating the overall method according to the present invention.

Referring first to FIG. 1, there is described a method for controlling the usage of a roller cone type drill bit 10 as well as other aspects of the execution of a well drilling plan. Prior to the commencement of usage of the bit 10, certain measurements and other information, which make up the initial bit data, are taken from the bit 10 as indicated by the step box 12. These data are entered into a computer 22 as indicated by the arrow 20.

The bit 10 is run into a well 16 on drill string 15 and commences drilling in that well as indicated by the step box 18.

As indicated by the step box 24 and arrow 26, certain constant and real-time drilling values are obtained from the drilling operation 18 using well known techniques as needed. These values make up the drilling data which are entered into computer 22 as indicated by arrow 28.

In a manner to be described more fully below, the computer 22, which is programmed with special software forming a part of the present invention, calculates current abrasive wear of the cutting structure of bit 10 on an ongoing or continual basis. As indicated by arrow 30, the computer is connected to an output device 32 which provides a perceptible indication of the current wear. Thus, the output as to wear is indicated by the device 32. In FIG. 1, device 32 is diagrammatically indicated as a visible scale having a movable indicator 34 which can track between a zero point at the left end of the scale to a limit at the right end. An operator controls continued usage or retirement of the bit 10 in accord with the current reading of device 32 as indicated by arrow 36.

Specifically, as long as the indicator 34 is located below the right hand limit point, the operator will allow continued usage of the bit in the well 16. However, when the indicator 34 reaches the right hand limit, the operator will instruct that the bit be removed from the well 16 and retired, as indicated by arrow 38. ("Retirement" as used herein does not preclude re-dressing for later use.)

It should be understood that the device 32 as illustrated is only a diagrammatic and representative device, and that various other types of output devices may be used either alone, or in conjunction with one another. For example, the output device might be a plotter or printer and might be used in conjunction with another device which will produce an audible signal or alarm when the limit is reached. Even a visual scale type device, as illustrated, could be modified in many ways. For example, it may not indicate a specific limit, but rather the operator could simply watch for a certain numerical value, identified in advance, as the limit for a given bit.

As will be explained more fully below, a by product of the preferred software for determining bit wear is pore pressure. This can be transmitted from the computer 22 to another suitable output device 42 as indicated by line 40. Then, as indicated by line 44, this pore pressure can be used to control other aspects of the execution of the well drilling plan, e.g. whether or not, and when to change mud weight, how much to change the mud weight, and when to set casing. Given a pore pressure value, it is well known in the art how to relate this to mud weight and casing plan. For example, an increase in pore pressure generally indicates a need for an increase in mud weight.

Referring now to FIGS. 4–6, the various bit data determined as indicated at step box 12, will be described. FIG. 4 is a simplified representation of a typical roller cone type drill bit. In the exemplary embodiment of the method of the present invention to be described, the software and calculation methods are tailored for roller cone type bits. However, it is believed that, using similar general principles, the method and software could be modified to calculate wear of other types of bits, such as drag bits, so long as the bits in question do undergo substantial external abrasive wear by the formation. Roller bit 10 is shown in the well bore 16 so as to better illustrate its operation and drilling environment. It will be understood that the measurements taken at step 12 are taken before the bit is put into the borehole and commences drilling.

Bit 10 includes an uppermost threaded pin 46 whereby the bit is attached to the drill string 15. A central flowway 48 opens in through the upper end of pin 46 and branches out through the crown 47 of the bit body, there communicating with several nozzles, one of which is diagrammatically shown at 50. In use, drilling mud is pumped through passageway 48 and nozzle 50 to cool the cutting structures and carry the cuttings back up through the annulus 52 of the well 16.

Below its crown portion, the bit body branches into several legs. A typical bit includes three such legs, and two of the three are shown at 54 in FIG. 4. Each leg 54 rotatably mounts a roller cone 56 having exterior cutting structures in the form of teeth 58. Bearings 60 are provided between the cones 56 and their respective legs 54 to facilitate rotation.

The bit values measured at step 12 and forming the bit data subset of the input data for the computer 22 include the overall diameter $D_b$ of the bit taken at its widest part, the inner diameter $D_n$ of the nozzle 50, the number of nozzles, $N_n$, and the number of teeth, $N_t$.

Each bit has a profile surface 61 which can be generated by connecting the outer surfaces of the lowermost teeth 58 on the cones 56. In use, this profile generally coincides with the profile 61 of the earth formation as it is drilled by the bit 10. Another of the bit data used in the present invention is the distance $H_b$ from the outermost end of the nozzle 50 to the outermost point of the profile surface 61, measured perpendicular to the centerline of the bit. It should be understood that, in some bits, the nozzles project outwardly from the bit body more than in the embodiment illustrated, so that this distance $H_b$ is not necessarily the same as the distance from the underside of the crown 47 of the bit body to the profile surface 61.

It can be seen that various of the teeth 58 on each cone 56 are of different sizes and are located at different positions along the longitudinal extent of the cone 56. In general, those teeth closest to the base of the cone are largest, while those closest to its tip are smallest. Certain of the bit data are taken from measurements of these teeth. In the embodiment being described herein, an exemplary bit tooth **58*a* is chosen for calculation purposes, and is assumed to represent an average size and position. To enhance the accuracy of such an extrapolation, the exemplary tooth 58*a*** is selected at a point approximately midway between the relatively large tooth adjacent the base of the cone and the relatively small tooth near the tip of the cone.

In the exemplary bit illustrated, the teeth 58 are of the milled type, which are formed integrally with their cones 56. They may or may not be hard faced. Other types of teeth, such as teeth which are separately formed and inset into their cones, are also employed in roller cone bits. Wear of any of these tooth types can be calculated in accord with the present invention, but different input data are needed for each type.

Thus, another factor which may be considered part of the bit "measurements" for present purposes is the factor $B_t$ which reflects the type of bit, i.e. either milled tooth or insert type.

In preferred embodiments, the bit values also include parameters based on the material(s) of which the teeth are formed. If the tooth has hard facing, these values will include the hardness, $G_f$, and thickness, $H_f$, of the hard facing layer, and in any event, these values will include the hardness, $G_t$, of the basic material of the main body of the tooth.

The exemplary milled tooth **58*a* used for averaging purposes in the exemplary embodiment includes leading and trailing surfaces 64 and 66 (with reference to the direction of movement of the tooth in use), and side surfaces 68. The leading and trailing surfaces 64 and 66** are disposed at an angle $\alpha$ while the side surfaces are disposed at an angle $\beta$. In the embodiment shown, $\alpha$ is part of the bit data.

The tooth **58*a* also has a tooth flat 70 at its outer end, which is the portion of the tooth which contacts the earth formation. Among the initial measurements taken at step 24 are the initial tooth flat length, $L_t$, being the length of the flat 70 measured between sides 68, and the initial tooth flat width, $W_{ti}$, being the extent of the flat 70 parallel to the direction of travel, i.e. between leading and trailing surfaces 64 and 66**.

Another item of bit data is the current tooth flat width, $W_{tc}$. At the beginning of a bit run, $W_{tc}=W_{ti}$. $W_{tc}$ is periodically updated on the basis of wear calculations made in accord with the invention, as explained below. However, because $\beta$ is so small, tooth flat length, $L_t$, will change little through an acceptable amount of wear. Therefore, in this embodiment, $L_t$ is assumed constant, and $\beta$ is not part of the bit data, although they might be used in other embodiments, as will be apparent to those of skill in the art.

The initial tooth height, $H_t$, measured from the base of the tooth (where it meets its cone) to its flat 70, is another one of the bit data. The bit data also include two other values, which can be calculated from bit measurements or taken from manufacturers' specs. These are the volumetric rate of mud flow through the bit nozzle 50, $V_m$, and the velocity of mud flow through the bit nozzle, $S_m$. The bit data also include a pair of wear coefficients, $C_{sha}$ and $C_{sa}$, for shale and sandstone, respectively, and which vary depending on the type of tooth, i.e. milled steel (as shown), tungsten carbide faced steel, or tungsten carbide insert. For a milled steel tooth, as shown, $C_{sha}=12\times10^{-6}$ and $C_{sa}=192\times10^{-6}$.

To summarize, the bit data for a preferred embodiment, along with their units of measurement, include:

bit diameter, $D_b$, in.
ID of nozzle, $D_n$, 1/32 in.
distance of nozzle from profile, $H_b$, in.
bit type factor, $B_t$, no units
hardness of tooth, $G_t$, kg./mm$^2$
first included angle, $\alpha$, degrees
second included angle, $\beta$, degrees
initial tooth flat width, $W_{ti}$, in.
current tooth flat width, $W_{tc}$, in.
shale wear coefficient, $C_{sha}$, no units
sandstone wear coefficient, $C_{sa}$, no units
tooth flat length, $L_t$, in.
tooth height, $H_t$, in.
volumetric rate of mud flow through nozzle, $V_m$, gal./-min.
velocity of mud flow through nozzle, $S_m$, cm./sec.
number of nozzles, $N_n$, no units
number of teeth, $N_t$, no units $S_m$ is included in the start-up data for convenience, although it will be appreciated that $S_m$ could be calculated by the computer from $D_n$ and $V_m$.

In addition, if the teeth are hard faced, the data will include:

thickness of facing, $H_f$, in.
hardness of facing, $G_f$, kg./mm.$^2$

The second subset of input data, i.e. the drilling data, are either known at the outset and remain constant or are taken from real-time drilling values measured at step 24. These include:

mud weight, $M_m$, lb./gal.
mud viscosity, T, poise
weight-on-bit, $M_b$, lb.
speed of bit, $S_r$, rpm
rate of penetration of bit, $S_b$, ft./hr.
height of kelly bushing, $H_k$, ft.
water depth (for offshore wells), $H_w$, ft.
measured depth of well, $W_m$, ft.
true vertical depth of well, $W_v$, ft.

With the exception of a few empirically determined constants, which will be pointed out below, all constants for which actual numerical values are given in the equations and other relationships below are conversion factors. If the above listed units of measurement are used for the data, these conversion factors eventually cancel out of the equations and become superfluous. The same would be true if another, e.g. metric, scheme of consistent units were used. However, if the units of only certain data are changed, different, and necessary, conversion factors will be needed, as will be apparent to those of skill in the art.

The mud type, i.e. fresh water, salt water or oil-based, should also be taken into account. The equations below are for a fresh water base, and some adjustments would be made in the constants for oil-based muds. Specifically, since the lubricity of an oil-based mud is about twice that of a fresh water-based mud, and the wear coefficient, $C_t$, discussed below, is inversely proportional to lubricity, it would be appropriate to divide $C_t$ by 2 to adjust for use of an oil-based mud. Similar adjustments might be made for salt water-based muds.

Figure 7:
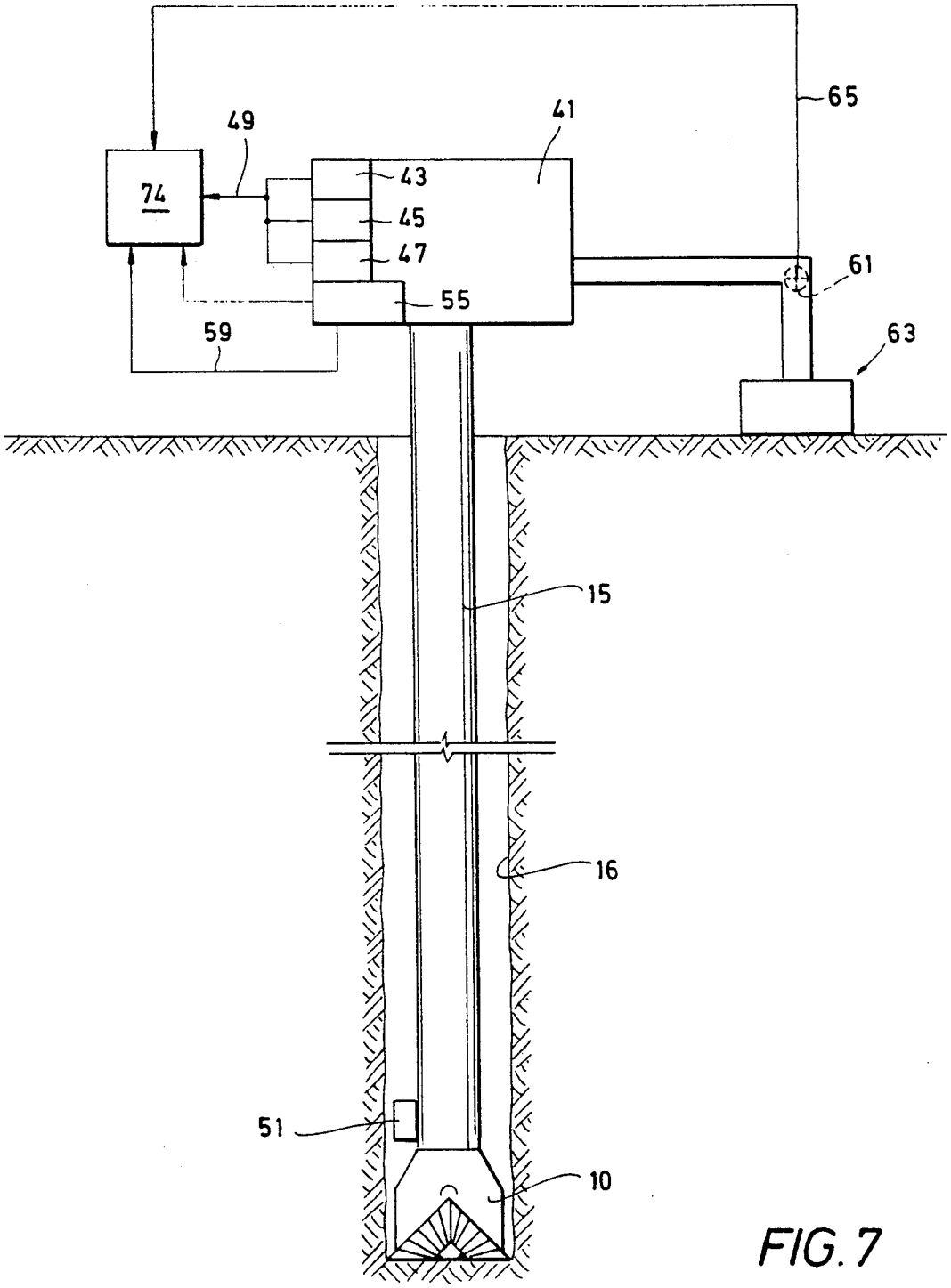
FIG. 7 is a diagrammatic view of the well illustrating means for determining current or real time drilling data.

Referring now to FIG. 7, determination of those drilling values which vary while drilling is diagrammatically illustrated. FIG. 7 may thus be considered a more detailed rendition of step box 24 in FIG. 1.

Equipment such as the kelly, rotary table, etc., located on the drilling platform is cumulatively and diagrammatically indicated at 41. Measured depth of well, $W_m$, rotary speed of bit, $S_r$, and rate of penetration, $S_b$, can be measured or otherwise determined by conventional instruments, well-known in the art, located on or about equipment 41. Such instruments, for measuring $W_m$, $S_r$ and $S_b$, respectively, are diagrammatically represented by black boxes 43, 45 and 47. Their outputs can be converted, by well known means, into electrical signals fed into memory 74 of computer 22 by lines 49, or they may have visual outputs which are fed into computer 22 by an operator.

The measurement of weight on bit, $M_b$, can utilize a signal from a well-known downhole instrument, such as strain gauge 51. The output from this instrument may be conveyed to the surface by well known means, such as mud pulse telemetry. The signal is received by a receiver apparatus 55, which converts it to an electrical signal which can be fed to memory 74 by line 59 or manually. Alternatively, $M_b$ can be determined from hook loads measured by a strain gauge adjacent the draw works, i.e. as the difference in the hook loads before and after the bit is placed on the bottom of the hole.

If mud weight, $M_m$, or viscosity, T, change during operation, this can be determined by conventional instrumentation 61 in the mud circulation system 63 to produce electrical outputs communicated to memory 74 by line 65. Alternatively, the operator can input the change(s) manually.

True vertical depth, $W_v$, is determined from periodic surveys taken, by well-known means, intermittently with episodes of drilling. If desired, $W_v$ can be roughly adjusted between surveys by extrapolating from corresponding changes in $W_m$.

Figure 3:
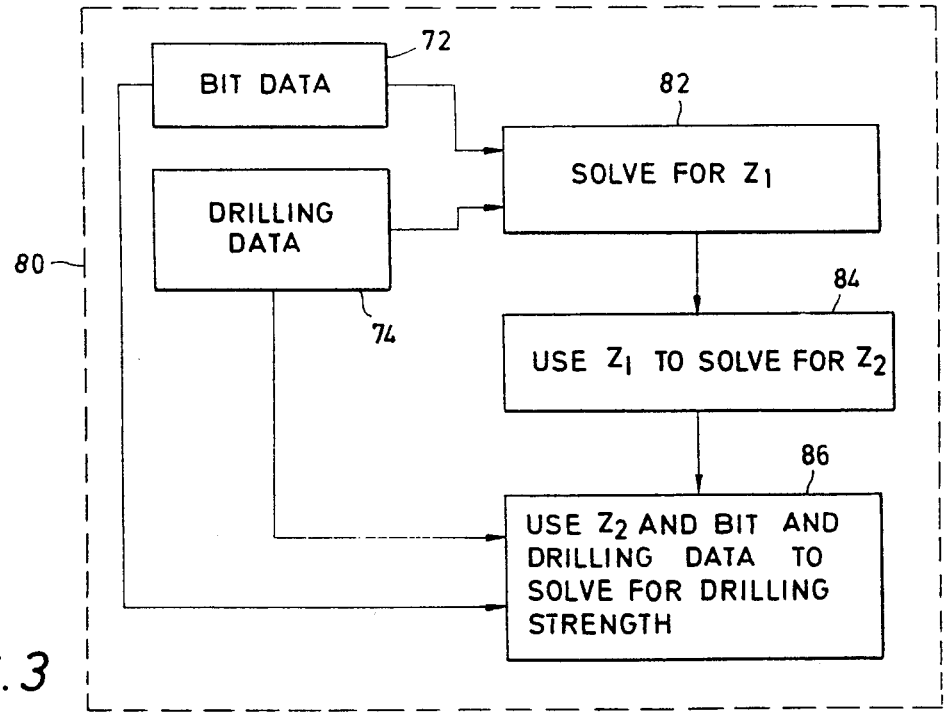
FIG. 3 is a flow diagram of the subsystem represented by block 80 in FIG. 2.

Referring now to FIG. 2, the operations of the computer 22 will be generally described. As previously mentioned, there are two subsets of input data, the bit data 72 constituting and/or extrapolated from the bit measurements taken at 12, and the drilling data 74, from the known and real-time drilling values determined at 24. Boxes 72 and 74 may also be considered to represent memories containing these data. Other boxes in FIGS. 2 and 3 are called "step boxes" herein. They represent steps in the method as well as means, in computer 22, for performing those respective steps. As indicated by arrows 76 and 78, at least some of the parameters in these two subsets of data are communicated to a subsystem 80 wherein the drilling strength of the lithology currently being drilled is computed. This subsystem is shown in greater detail in FIG. 3 and will now be described with reference to FIG. 3.

Certain of the bit data 72 and drilling data 74 are used to solve for an intermediate parameter designated $Z_1$, as indicated at 82. The computer 22, and specifically its subsystem 80, is programmed with appropriate software to solve for $Z_1$ in accord with the following functional relationships and definitions:

The variable $Z_1$ is a dimensionless stress-strain relationship defined by the equation:

$$Z_1 = \frac{(0.008466 S_b)\ (\text{hydraulic impact energy})}{d_1}, \quad (1)$$

where $$d_1 = \frac{(\text{Reynold's number})\ (\text{mud density})\ (\text{bit characteristic number})\ (S_r)\ (\text{hydraulic impact velocity})^3}{} \quad (2)$$

The factors of $d_1$ are, in turn, defined by the following relationships:

$$\text{Reynold's number} = \frac{(\text{mud density})\ (S_m)\ (\text{bit characteristic number})}{T} \quad (3)$$

where $$\text{mud density} = \frac{M_m}{8.34},$$

and bit characteristic number $= 2.54\ [D_b H_t W_{ti}]^{\frac{1}{3}}$.

Substituting the definitions of mud density and bit characteristic number into equation (3), we get a formula for Reynold's number. Substituting the resulting definition of Reynold's number into equation (2), and also substituting the definitions of mud density and bit characteristic number into equation (2), we get a formula for $d_1$. Substituting this definition of $d_1$ into equation (1), we get $Z_1$ expressed in terms of the above basic input data and two intermediate terms, hydraulic impact energy (total) and hydraulic impact velocity.

In defining the latter two intermediate terms, we utilize two other intermediate terms, $S_f$ and $S_e$. $S_f$ is the mud flow velocity at the profile surface 61 (FIG. 4), and $S_e$ is an adjusted mud flow velocity. It is known that $S_f$ can be defined in terms of basic input data as:

$$S_f = \frac{63.09\ V_m}{\Sigma\ \text{nozzle areas}} = \frac{63.09\ V_m}{\Sigma \pi\ (D_n/2)^2}.$$

We also utilize intermediate terms E, or energy, and H, or hydraulic impact energy per nozzle, defined as:

$$H = (\text{mud density})\ (S_f)^3 (\pi)\ (2.54\ D_n)^2/8 = \frac{(M_m)}{8.34}\ (S_f)^3\ (\pi)\ \frac{(2.54\ D_n)^2}{8}$$

Based on empirical findings, we have defined a limit R, in terms of basic input data, to adjust for certain bit designs in which the nozzles extend away from the crown of the bit: $R = H_b/D_n$. It has been empirically determined that, if $R > 6$, then $$S_e = \frac{6.2\ S_f}{R},$$

and $$E = \frac{4.1\ H}{R},$$

and if $R \leqq 6$, then $$S_e = S_f,$$

and $$E = H(1 - 0.0896R + 0.0058R^2).$$

Since $S_f$ and R are defined in terms of basic input data, H and $S_e$ are defined in terms of $S_f$ and R, and E is defined in terms of H and R, $S_e$ and E are ultimately determinable from the input data. Note that the constants in the above definitions of $S_e$ and E are necessary empirical constants, not conversion factors.

We then define:

hydraulic impact energy $= \Sigma E$ for all nozzles, and $$\text{hydraulic impact velocity} = \frac{\Sigma S_e}{N_n}.$$

Accordingly, reverting to the mathematical definition of $Z_1$, and substituting for hydraulic impact energy and hydraulic impact velocity, $Z_1$ can be defined completely in terms of the input data. There are two possible equations for $Z_1$, depending on whether $R > 6$ or $R \leqq 6$. The software for step 82 (FIG. 3) may be operative to compute R from input data, compare R to 6, and then use one or the other of these two equations to solve for $Z_1$ in terms of input data. R will remain constant for a given bit, and so will the ultimate equation for $Z_1$.

Referring again to FIG. 3, $Z_1$ is transmitted to the next step 84 of the software, where $Z_1$ is used to solve for another dimensionless stress-strain relationship term $Z_2$, by the following equation:

$$Log\ (Z_2) = 28.26939 + 6.097267\ Log(Z_1) + 0.302986\ [Log(Z_1)]^2 \quad (4)$$

All constants in equation (4) are necessary empirical constants, not conversion factors.

While steps 82 and 84 have been described as separate steps to facilitate understanding, it should be understood that they can be combined in the software. Specifically, in equation (4), each occurrence of $Z_1$ can be replaced by its formula for $R > 6$, expressed in input data and derived as explained above. The same is repeated using the $Z_1$ formula for $R \leqq 6$. This results in two equations for $Z_2$, in terms of the input data, one for $R > 6$ and one for $R \leqq 6$. The computer can then be programmed to go directly from computation of R and comparison of R with 6 to computation of $Z_2$, using the appropriate one of such two formulas.

$Z_2$ is also functionally related to drilling strength in terms of input data. Transmitting $Z_2$ and the data by which it is related to drilling strength to step 86, this relationship is used to solve for drilling strength. The relationship is developed below. To the extent that certain terms have already been defined in developing $Z_1$, their definitions will not be repeated.

$$Z_2 = \frac{4.448 \times 10^5 M_b(\text{mechanical stress} + \text{hydraulic stress})}{d_2} \quad (5)$$

$$\text{Mechanical stress} = \frac{4.448 \times 10^5 M_b}{A_k N_k}$$

$$A_k = 2.54^2 W_{tc} D_b$$

$$N_k = \text{number of teeth in contact with formation} = B_t N_t.$$

(It has been empirically determined that $B_t=0.15$ for milled tooth roller cone bits, and $B_t=0.11$ for insert tooth roller cone bits.) Thus, mechanical stress can be expressed in terms of basic input data.

$$\text{Hydraulic stress} = \left[\frac{(\text{mud density})\,(\Sigma\ \text{area of nozzles})\,(\text{hydraulic impact velocity})}{A_k}\right]^2$$

$$\text{where area of nozzle} = \pi(2.54\ D_n/2)^2.$$

Thus, recallingg that hydraulic impact velocity can be expressed in terms of basic input data, and $S_e$ can be determined from basic input data, hydraulic stress can be expressed in terms of basic input data. Also, $$d_2 = (\textit{drilling strength})^2 \quad (6)$$

Substituting from the above into equation (5), we can derive an equation for $Z_2$ in terms of basic input data and drilling strength.

Solving equation (4) for $Z_2$, and substituting that solution for $Z_2$ into the last-mentioned equation for $Z_2$, we can then solve for drilling strength, the only remaining unknown.

It should be noted that such solution for drilling strength will involve the term $S_e$, which as explained above has two different definitions, depending upon whether $R>6$ or $R\leqq 6$. As one of skill in the art will appreciate, the software can be developed in any one of a number of equivalent ways, to take this into account. For example, the calculation and comparison of R which precedes the solution for $Z_1$ at step 82 can be used again at step 86 to select one of two different formulas for drilling strength developed from the two respective definitions of $S_e$. Alternatively, the comparison of R with 6 can be made again at step 86.

However, this probably becomes moot for the following reason: Just as steps 82 and 84 were described separately to facilitate understanding, but could be combined into one step as explained above, that one step could likewise be combined with step 86. That is, it is possible to develop two equations for drilling strength, one for $R>6$ and one for $R\leqq 6$, with each of those two equations expressed entirely in terms of the input data. Indeed, the computation of drilling strength is indicated as a single step at 80 in FIG. 2. Step 80 may consist of an initial evaluation and comparison of R to select one of two equations for drilling strength which may then be used throughout the process as long as the same drill bit is being employed. Alternatively, step 80 may contain substeps, as shown in FIG. 3 and described above.

For simplification of the flowcharts of FIGS. 2 and 3, an arrow from a memory 72 or 74 means that at least some, but not necessarily all, of the data in that memory are used in the step box to which the arrow is directed. Also, in some instances, data from the memory are also used in a subsequent step in a chain of step boxes, and that data is not necessarily used at each preceding step in the chain; arrows directly from the memory to the subsequent step box may be omitted to avoid confusing the chart with too many lines. Again, the same may be true of output from one step box connected to other step boxes in a chain. Thus, the chart should be read with this specification.

The drilling strength obtained at step 80 is next adjusted for differential pressure effects at step 88. This is done using the relationship:

adjusted drilling strength=(drilling strength) ($e^{-M\,dp}$) where M=0.001 (an empirically determined constant) and dp=the pressure differential across the wall of the well, i.e. between the pressure of the mud in the well and the pressure in the formation just outside the well.

$$dp = 0.05188\,[M_m\,W_v - q(W_v - H_k)]$$

where q=pore pressure.

Pore pressure, q, can be determined by conventional means or by a sub-routine indicated at 120 and described below.

The adjusted drilling strength obtained at step 88 is then transmitted to step 90 where it is compared with at least one drilling strength reference so that the corresponding lithology can be classified as to type. For the vast majority of formations, it is sufficient to classify each value obtained as either sandstone (abbreviated "sand" or "sa." herein) or shale ("sha."). As indicated by arrows 92 and 94, this comparison, and more specifically the drilling strength references, utilize the current shale and sand baselines developed at steps 106 and 108 as described below.

If:

sha. baseline − 3(sha. std. dev.) < drilling strength < sha. baseline + 3(sha. std. dev.), then the lithology which yielded that drilling strength is classified as a shale.

If:

sa. baseline − 3(sa. std. dev.) < drilling strength < sa. baseline + 3(sa. std. dev.), then the lithology corresponding to that drilling strength is classified as a sand.

Each drilling strength, so classified, is then paired with the respective true vertical depth, $W_v$, for which it was obtained, since drilling strength increases with depth. $W_v$ is supplied to step 90 from the drilling data 74 as indicated by arrow 96.

If the drilling strength has been classified as a shale, that drilling strength, as paired with the corresponding true vertical depth, $W_v$, is placed in an array 98 of fifty such drilling strength\true vertical depth pairs, as indicated by arrow 102. When the most recent such pair, $W_{vn}$\shale drilling strength$_n$, is placed into the array, the oldest such pair, $W_{vn-50}$\shale drilling strength$_{n-50}$, is deleted, as indicated by the hatch lines through the lower end of the array 98. Thus, an array of the fifty most current such pairs of values for shale is maintained in the array 98.

Similarly, if a drilling strength is classified as a sand, it, paired with its respective true vertical depth, is placed in a sand array 100 as the most recent pair, $W_{vn}\backslash$shale drilling strength$_n$, as indicated by arrow 104, and the oldest such pair, $W_{vn-50}\backslash$sand drilling strength$_{n-50}$, is deleted.

Each time a new pair of values comes into the array 98, a new shale baseline or mean for the fifty current shale drilling strengths is computed as indicated at 106. A sand baseline or mean is similarly maintained on a current or updated basis as indicated at 108. As already mentioned, these current baselines are transmitted to the comparison and classification step 90 as indicated by arrows 92 and 94.

It will be appreciated that, upon start up of a bit run, a shale baseline and sand baseline will be needed for the comparison step at 90 until the arrays 98 and 100 fill up. For this start up purpose, we use the shale baseline from the last bit run and define:

$$\text{sa. baseline} = \frac{(\text{sha. baseline} + \text{sha. std. dev.})}{2}.$$

The shale and sand baselines obtained at steps 106 and 108 are transmitted to step 110 where the relative volumes of shale and sand are computed. This computation also utilizes the current adjusted drilling strength value, obtained at 88 and transmitted to 90, as indicated by arrow 112. The computation of relative volumes utilizes the following relationships:

$$\text{Vol.}_{sha} = \frac{\text{drilling strength} - \text{sa. baseline} - \text{sa. std. dev.}}{\text{sha.baseline} - \text{sha.std.dev.} - \text{sa.baseline} - \text{sa.std.dev.}}$$

and $$\text{Vol.}_{sa.} = 1.0 - \text{Vol.}_{sha.}$$

These equations are based on a simple linear normalization scheme, in accord with the exemplary embodiment, but other normalization schemes, such as geometric or logarithmic, might also be used in modified models.

For the primary function of the invention, the relative volumes of sand and shale are transmitted to step 114, where tooth wear is computed. The tooth wear computed at step 114 is the volume of bit tooth material which has been removed due to abrasion by the formation.

The software is based on the known Holm-Archard equation:

$$\text{wear vol.} = Y = \frac{M_b H_s C_t}{1420}. \quad (8)$$

$H_s$ is the sliding distance traveled. In some embodiments, $H_s$ may be multiplied by a factor, which would then be included in the basic bit data 72, to account for an increase in sliding distance caused by cone offset, i.e. where the axis of the cone does not lie in a true radial plane with respect to the axis of pin 46. For typical roller cone bits, this factor will be greater than 1 and less than or equal to 3, depending on the amount of offset. As mentioned above, the calculations are based on a single representative tooth. This tooth is assumed to be located at a distance from the bit axis of ½ the bit radius. Then, $$H_s = \frac{\pi(D_b/2)\,(\text{depth traveled})\,(S_r)\,(3600)\,(0.1047)}{S_b} = \frac{\pi(D_b/2)\,(W_{m\ new} - W_{m\ old})\,S_r(3600)\,(0.1047)}{S_b} \quad (9)$$

$C_t$ is a wear coefficient which can be determined from the volumes calculated at step 110 and empirically derived shale and sand wear coefficients, $C_{sha}$ and $C_{sa}$ respectively, and adjusted for the type of mud. $C_{sha}$ and $C_{sa}$ take into account that, although drilling progresses more rapidly through sandstone than through shale, i.e. sandstone has lower drilling strength, sandstone is substantially more abrasive than shale. Thus it is not accurate to assume that a decrease in rate of penetration indicates rapid tooth wear, as was done in the past. For fresh-water-based mud:

| | milled steel tooth | tungsten carbide insert | tungsten carbide facing on steel |
|---|---|---|---|
| $C_{sha}$: | $12 \times 10^{-6}$ | $1 \times 10^{-6}$ | $.2 \times 10^{-6}$ |
| $C_{sa}$: | $192 \times 10^{-6}$ | $50 \times 10^{-6}$ | $9 \times 10^{-6}$ |

Then, $$C_t = \text{Vol}_{sha}\,C_{sha} + \text{Vol}_{sa}\,C_{sa} = 0.15\,\text{Vol}_{sha} + 1.62\,\text{Vol}_{sa}. \quad (10)$$

Substituting from equations (10) and (9) into equation (8), we can derive an equation for Y in terms of basic input data and the shale and sand volumes determined at step 110, which equation is incorporated in the software. This gives the total volume of material worn from the bit teeth. The wear per tooth, $Y_t$, can be determined from:

$$Y_t = \frac{Y}{N_t}. \quad (11)$$

Once again, the calculations have been described separately to facilitate understanding, but could be combined in the software.

In preferred embodiments, $C_t$ is chosen taking into account the hardness of the material of which the tooth is formed. If the tooth has layers of different hardnesses, e.g. $G_t$ and $G_f$ if it is hard faced, the software can be adapted to modify $C_t$ when $Y_t$ reaches a value which indicates that the hard facing layer has been worn away. The latter can be done using the facing thickness $H_f$, as will be apparent.

Once the volumetric wear per tooth is obtained, its value is transmitted to step 116 where, utilizing the data $H_t$, $\alpha$, $\beta$, and/or the last $A_c$ value, along with conventional geometric calculation techniques, a value for the current wear flat area $A_c$ is computed. From this and $L_t$, $W_{tc}$ may be computed. Either $A_c$ or $W_{tc}$ can be the output value transmitted to the device 32 as indicated by arrow 30 and described above. $W_{tc}$ is also transmitted, as indicated by arrow 118, back to the bit data portion 72 of the memory to replace the last $W_{tc}$ value therein. Thus, subsequent calculations throughout the program will be performed using the new tooth flat width. However, when the value of $W_{tc}$(or $A_c$) reaches the limit displayed by device 32, the operator will retire the bit, as described above.

The operations up to this point, culminating in an indication of tooth wear, represent a primary purpose of the present invention. As noted above, the program can compute pore pressure q at 120 and this can be used to evaluate the differential pressure dp which is used at step 88, as indicated by arrow 132, instead of empirical information from previous wells.

This is done using the following relationships and definitions:

$$dq = -1000.06 \ln\left(\frac{dsha}{\text{shale baseline}} + 1\right)$$

$$q_{new} = q_{old} + dq$$

where $dq$ = change in pore pressure (psi)

$dsha$ = change in shale baseline (psi)

Upon startup, $q_{old}$ can be taken from data from a nearby well or determined by any known conventional method. A particularly accurate method and system might be developed by combining the use of the present invention with the pore pressure determination method described in the aforementioned U.S. Pat. No. 4,981,037. Pore pressure is also an independently useful by-product of the software. As mentioned, aspects of the well drilling plan other than bit replacement, e.g. when and by how much to change mud weight and when to set casing, can be controlled, i.e. either maintained or modified, based on the pore pressure value, as will be appreciated by those of skill in the art.

Numerous modifications of the invention as described above will suggest themselves to those of skill in the art. For example, the exemplary embodiment above treats the sandstone as being of the quartz type. Suitable modifications can be made to further refine the calculations for formations including limestone rather than quartz-type sandstone. Like quartz sandstone, limestone is more abrasive than shale. It is also possible to expand the software to consider more than two different types of lithology. Accordingly, it is intended that the present invention be limited only by the following claims.

What is claimed is:

1. A method of controlling drill bit usage, comprising the steps of:

drilling at least a portion of a given oil or gas exploration or production well with a given drill bit;

continually measuring drilling data from the well and producing outputs indicative of the drilling data;

converting the outputs indicative of the drilling data into electrical drilling data signals and inputting the electrical drilling data signals to a computer;

continually processing the drilling data signals to produce a variable signal indicative of an abrasive-wear-affecting variable for the lithology which has been most recently drilled with said bit;

continually processing the variable signal to calculate current abrasive wear of the bit by the total lithology which has been so drilled thereby and produce a wear calculation signal; and continuing use of the bit or retiring the bit in accord with said wear calculation signal.

2. The method of claim 1 wherein each current wear calculation also applies the preceding wear calculation signal.

3. The method of claim 1 wherein said abrasive-wear-affecting variable is drilling strength of the formation; and said wear is so calculated as a function of at least the following:

(a) a signal indicative of linear distance traversed by a point on the drill bit; and (b) a signal indicative of said drilling strength.

4. The method of claim 3 wherein said wear is so calculated as a function also of a signal indicative of a wear coefficient, which is adjusted for said recently drilled lithology.

5. The method of claim 4 wherein said signal indicative of the wear coefficient is adjusted so as to produce such wear calculations increasing in magnitude as the proportion of shale relative to a more abrasive material, in the lithology so drilled, decreases.

6. The method of claim 4 wherein said signal indicative of the wear coefficient is also adjusted for the nature of the drilling mud being used.

7. The method of claim 3 comprising continually measuring the depth of said well and wherein:

said signal indicative of drilling strength is revised each time said bit increases the depth of the well by a given increment;

each drilling strength signal so obtained is compared with at least one drilling strength reference and classified as one of at least two given categories of lithology;

respective arrays of drilling strengths are maintained for each such category, each drilling strength, as it is so classified, being entered into the respective array and the oldest drilling strength in said array being simultaneously removed;

the drilling strengths in each respective array are averaged;

the relative volumes of each category of lithology are calculated as functions of said averages; and said wear is so calculated as a function of drilling strength by calculating wear as a function of said relative volumes of said categories of lithology.

8. The method of claim 7 wherein, prior to being so compared and classified, each drilling strength is adjusted for the pressure differential across the well bore/-formation interface.

9. The method of claim 8 further comprising processing at least one of said array averages to produce a signal indicative of pore pressure.

10. The method of claim 9 comprising processing said pore pressure to produce a signal indicative of said differential pressure.

11. The method of claim 7 wherein said drilling strength is so evaluated as a function of:

(a) bit data taken from the configuration of said bit; and (b) drilling data representing current drilling conditions.

12. The method of claim 11 wherein at least some of said drilling data are obtained by measuring while drilling.

13. The method of claim 12 wherein said bit data are constantly adjusted based on the most recent such wear calculation.

14. The method of claim 13 wherein said wear is calculated as a function also of a wear coefficient, which is adjusted for recently drilled lithology.

15. The method of claim 14 wherein said wear coefficient is also adjusted for the nature of the drilling mud being used.

16. The method of claim 13 wherein said wear calculation includes calculation of a current tooth flat parameter which is used as part of said bit data.

17. The method of claim 16 comprising including tooth hardness in said bit data.

18. The method of claim 17 wherein the bit teeth are hard faced, and said bit data further include thickness of tooth facing and hardness of tooth facing.

19. The method of claim 17 comprising including in said drilling data:

(a) mud weight;
(b) mud viscosity;
(c) weight-on-bit;
(d) revolutions per minute of bit;
(e) rate of penetration of bit;
(f) height of kelly bushing;
(g) water depth;
(h) measured depth of well;
(i) true vertical depth of well; and further including in said bit data:
(a) diameter of bit;
(b) inner diameter of nozzle;
(c) distance of nozzle from bit profile;
(d) bit type factor;
(e) tooth geometry data from which a current tooth flat parameter can be calculated;
(f) tooth height;
(g) initial tooth flat parameter;
(h) current tooth flat parameter;
(i) total number of teeth;
(j) total number of nozzles;
(k) volumetric rate of mud flow through bit nozzle;
(l) a respective wear coefficient for each of two major lithology types, chosen for tooth type.

20. The method of claim 19 wherein said tooth geometry data include initial tooth flat length and initial tooth flat width.

21. The method of claim 20 wherein said tooth geometry data include first and second included angles of tooth.

22. The method of claim 19 wherein said tooth geometry data include first and second included angles of tooth.

23. The method of claim 16 further comprising calculating pore pressure of the formation being drilled as a function of said drilling strength.

24. The method of claim 16 wherein said evaluating and calculating are performed in a data processing system.

25. The method of claim 1 wherein said evaluating and calculating are performed in a data processing system.

26. A method of controlling drill bit usage comprising the steps of:

drilling at least a portion of a given oil or gas exploration or production well with a given drill bit;

continually measuring drilling data from the well and producing outputs indicative of the drilling data;

converting the outputs indicative of the drilling data into electrical drilling data signals and inputting the electrical drilling data signals to a computer;

continually processing the drilling data signals to produce at least one signal indicative of the lithology which has been most recently drilled with said bit;

continually applying said signal indicative of said recently drilled lithology to adjust a wear coefficient signal;

continually processing the wear coefficient signal to calculate current abrasive wear of the bit and produce a wear calculation signal; and contining use of the bit or retiring the bit in accord with said wear calculation signal.

27. The method of claim 26 wherein said wear coefficient is adjusted so as to produce such wear calculations increasing in magnitude as the proportion of shale relative to a more abrasive material, in the lithology so drilled, decreases.

28. A data processing system comprising:

memory means for storing a set of bit data signals, including signals indicative of parameters of a drill bit, and a set of drilling data signals, including signals indicative of parameters of an oil or gas exploration or production well drilling operation being performed with said bit;

means for processing said data signals to produce a variable signal indicative of an abrasive-wear-affecting variable;

means for processing said variable signal to calculate abrasive wear of said bit as a function of said variable signal and produce a wear calculation signal; and an output device for providing a visual indication of said wear calculation signal.

29. The system of claim 28 wherein said means for processing said data signal is operative, upon updating of at least some of the data signals in said memory means to reflect current drilling and/or bit conditions, to revise said variable signal;

and said means for processing said variable signal is operative, upon such revision, to calculate cumulative wear of said bit.

30. The system of claim 29 further comprising means for reading a signal function of each such wear calculation signal into said memory means to so update said data signal, said means for processing said data signals being operative upon said signal function as at least a portion of the data signals on which said processing is based.

31. The system of claim 30 wherein said abrasive-wear-affecting variable is drilling strength of a formation being drilled; and said calculating means is operative to calculate said wear as a function of at least the following:

(a) a signal indicative of the linear distance traversed by a point on said bit; and (b) a signal indicative of said drilling strength.

32. The system of claim 31 wherein said means for processing said variable signal is operative to calculate said wear as a function also of a signal indicative of a wear coefficient, said system further comprising means for adjusting said wear coefficient signal in accord with such updated data.

33. The system of claim 32 wherein said means for adjusting said wear coefficient signal is operative to perform such adjustments such that said means for processing said variable signal will produce such wear calculations increasing in magnitude as the proportion of shale relative to a more abrasive material, in the lithology drilled, decreases.

34. The system of claim 32, further comprising means for comparing each drilling strength signal produced by said means for processing said data signals with at least one drilling strength reference and classifying said drilling strength signal as one of at least two given categories of lithology;

means for maintaining a respective array of drilling strengths for each such category of lithology, said array maintaining means being operative, upon classification of each drilling strength signal, to enter said drilling strength into the respective array and remove the oldest drilling strength in said array;

means for averaging the drilling strengths in each array, respectively;

means for determining the relative volumes of each category of lithology as functions of said averages; and wherein said means for processing said variable signal is operative to so calculate said wear as a function of said relative volumes of said categories of lithology.

35. The system of claim 34 further comprising means for adjusting each drilling strength signal for the differential pressure across the well bore/formation interface of said well, based on the data signals in said memory, prior to comparison and classification of said value by said classification means.

36. The system of claim 35 wherein said means for processing said variable signal is operative to calculate said wear as a current tooth flat parameter for a respective tooth of said bit.

37. The system of claim 36 wherein said bit data include tooth hardness.

38. The system of claim 37 wherein the bit teeth are hard faced, and said bit data further include thickness of tooth facing and hardness of tooth facing.

39. The system of claim 37 wherein said drilling date include:

(a) mud weight;
(b) mud viscosity;
(c) weight-on-bit;
(d) revolutions per minute of bit;
(e) rate of penetration of bit;
(f) height of kelly bushing;
(g) water depth;
(h) measured depth of well;
(i) true vertical depth of well; and said bit data further include:
(a) diameter of bit;
(b) inner diameter of nozzle;
(c) distance of nozzle from bit profile;
(d) bit type factor;
(e) tooth geometry data from which a current tooth flat parameter can be calculated;
(f) tooth height;
(g) initial tooth flat parameter;
(h) current tooth flat parameter;
(i) total number of teeth;
(j) total number of nozzles;
(k) volumetric rate of mud flow through bit nozzle;
(l) a respective wear coefficient for each of two major lithology types, chosen for tooth type.

40. The system of claim 39 wherein said tooth geometry data include initial tooth flat length and initial tooth flat width.

41. The system of claim 40 wherein said tooth geometry data include at least the larger of two included angles of tooth.

42. The system of claim 39 wherein said tooth geometry data include at least the larger of two included angles of tooth.

43. The system of claim 36 further comprising means for determining pore pressure of a formation being drilled by said bit as a function of said drilling strength signal.

44. The system of claim 43 wherein said means for adjusting each drilling strength signal for differential pressure is operative to receive and use a signal indicative of pore pressure to determine said differential pressure.

45. A method of controlling the execution of a well drilling plan, comprising the steps of:

drilling at least a portion of a given oil or gas exploration or production well with a given drill bit;

continually measuring drilling data from the well and producing outputs indicative of the drilling data;

converting the outputs indicative of the drilling data into electrical drilling data signals and inputting the electrical drilling data signals to a computer;

continually processing the drilling data signals to produce a drilling signal indicative of the drilling strength of the lithology which has been drilled by said bit, relative to said bit, and closely adjacent said bit;

continually processing the drilling strength signal to calculate pore pressure as a function of said drilling strength; and continuing or modifying said well drilling plan as a function of said pore pressure calculation.

46. The method of claim 45 wherein the continuance or modification of said well drilling plan comprises maintaining or modifying planned mud weight.

47. The method of claim 45 wherein the continuance or modification of said well drilling plan comprising maintaining or modifying a schedule for setting casing.

48. The method of claim 45 comprising continually measuring the depth of said well and wherein:

said drilling strength signal is revised each time said bit increases, the depth of the well by a given increment;

each drilling strength signal so obtained is compared with at least one drilling strength reference and classified as one of at least two given categories of lithology;

an array of drilling strengths is maintained for at least one such category, each drilling strength so classified as of said one category being entered into the array and the oldest drilling strength in said array being simultaneously removed;

the drilling strengths in the array are averaged;

and pore pressure is so calculated from said array average.

49. The method of claim 48 wherein, prior to being so compared and classified, each drilling strength is adjusted for the pressure differential across the well bore/formation interface.

50. The method of claim 49 comprising using said pore pressure to determine said differential pressure.

51. The method of claim 48 wherein said one category of lithology is shale.

52. A data processing system comprising:

memory means for storing a set of bit data signals, including signals indicative of parameters of a drill bit, and a set of drilling data signals, including signals indicative of parameters of an oil or gas exploration or production well drilling operation being performed with said bit;

means for processing said data signals to produce a drilling strength signal indicative of the drilling strength of the lithology drilled by said bit, relative to said bit, and closely adjacent said bit;

means for processing said drilling strength signal to produce a pore pressure signal indicative of pore pressure.

53. The system of claim 51 wherein said means for processing said data signals is operative, upon updating of at least some of the data signals in said memory means to reflect current drilling and/or bit conditions, to revise said drilling strength.

54. The system of claim 53 further comprising means for comparing each drilling strength signal with at least one drilling strength reference and classifying said drilling strength signal as one of at least two given categories of lithology;

means for maintaining an array of drilling strengths for at least one such category of lithology, said array maintaining means being operative, upon classification of each drilling strength signal as of said one category, to enter said drilling strength into the array and remove the oldest drilling strength in said array;

means for averaging the drilling strengths in the array; and wherein said means for processing said drilling strength signal is operative to so calculate said pore pressure as a function of said average.

55. The system of claim 54 further comprising means for adjusting each drilling strength signal for the differential pressure across the well bore/formation interface of said well, based on the data signals in said memory, prior to comparison and classification of said drilling strength signal by said classification means.

56. The system of claim 55 wherein said means for adjusting each drilling strength signal for differential pressure is operative to receive and use a signal indicative of said pore pressure to determine said differential pressure.

* * * * *

UNITED STATES PATENT AND TRADEMARK OFFICE

CERTIFICATE OF CORRECTION

PATENT NO. : 5,305,836

DATED : April 26, 1994

INVENTOR(S) : Philip Holbrook and Sanjeev Mittal

It is certified that error appears in the above-identified patent and that said Letters Patent is hereby corrected as shown below:

In column 22, line 26, insert --strength-- after "drilling".

Signed and Sealed this

Fourth Day of October, 1994

*Attest:*

*Attesting Officer*

Bruce Lehman

BRUCE LEHMAN

*Commissioner of Patents and Trademarks*